US005864209A

United States Patent [19]

Clark

[11] Patent Number: 5,864,209

[45] Date of Patent: Jan. 26, 1999

[54] CATHODE FILAMENT FOR AN ULTRA-VIOLET DISCHARGE LAMP

[75] Inventor: David Lyle Clark, Elmira, N.Y.

[73] Assignee: Imaging & Sensing Technology Corporation, Horseheads, N.Y.

[21] Appl. No.: 739,806

[22] Filed: Oct. 30, 1996

[51] Int. Cl.[6] ..... H01J 17/04

[52] U.S. Cl. ..... 313/622; 313/578; 313/631; 313/344

[58] Field of Search ..... 313/578, 579, 313/622, 631, 341, 344, 345

*Primary Examiner*—Vip Patel

*Attorney, Agent, or Firm*—Phillips, Lytle, Hitchcock, Blaine & Huber LLP

[57] ABSTRACT

A unique cathode (30) for an ultraviolet discharge lamp (10) is described. The cathode includes a triple-coil wire, i.e., the wire has a primary coil (43), a secondary coil (41) wound around the primary coil and a tertiary coil (36) wound around the secondary coil. The interstices of the primary coil and secondary coil, but not the tertiary coil, are occupied by a crystalline oxide emitter material. Filling the primary and secondary coils of the triple coil cathode provides a cathode having a greater amount of emitter material than prior art. In addition, as the outer layer of the emitter material sputters away from bombardment by positive ions, the remaining emitter material is protected by the now-exposed portion of the coil wire which protrudes beyond the remaining emitter material. Thus, incoming positive ions are apt to strike the exposed wire, and not the remaining emitter material.

6 Claims, 4 Drawing Sheets

CATHODE FILAMENT FOR AN ULTRA-VIOLET DISCHARGE LAMP

TECHNICAL FIELD

The current invention relates to ultraviolet discharge lamps, otherwise known as ultraviolet sources, and, more particularly, to ultraviolet discharge lamps filled with hydrogen or deuterium gas utilizing a "hot" cathode.

BACKGROUND OF THE INVENTION

Hydrogen and deuterium-filled ultraviolet discharge lamps ("UV lamps") are well known. Examples are described in U.S. Pat. Nos. 5,159,236 (INDIRECTLY HEATED CATHODE FOR A GAS DISCHARGE TUBE) and 4,910,431 (HYDROGEN DISCHARGE UV LIGHT SOURCE OR LAMP, AND METHOD OF ITS MANUFACTURE), the disclosures of which are hereby incorporated by reference. UV lamps provide a broad-band continuous spectrum ultraviolet light, (generally in a range between the wavelengths of approximately 160 nm and approximately 360 nm. UV lamps are used in applications such as high performance liquid chromatography (HPLC), ultra violet visible absorption spectroscopy (the measurement of the wavelength and intensity of absorption of near-ultraviolet light by a sample), and atomic absorption spectroscopy (AA).

Typically, a UV lamp comprises a sealed quartz or ultraviolet glass bulb filled with a gas, such as hydrogen or deuterium. It is also known to use neon, argon, krypton and xenon in addition to $H_2/D_2$ bulbs. The bulb also contains an anode/cathode combination. The cathode is traditionally a double-coil tungsten wire. "Double-coil" describes a wire comprising a primary and secondary coil. That is, a length of wire has been wrapped around a mandrel to form a primary coil, and the primary coil is then wrapped around a second, larger mandrel to form a secondary coil. The cathode is coated with an electron-emitting material, such as an alkaline earth oxide (e.g., barium oxide, calcium oxide, strontium oxide,) etc. or an alkaline earth mixture.

UV lamp cathodes can either be directly heated ("hot cathode") or indirectly heated (see '236 patent, supra). Heating the cathode raises the temperature of the emitter material until it freely emits electrons, or becomes thermionic. When an appropriate voltage is applied across the anode and cathode, and the cathode is thermionic, the cathode will emit electrons allowing a current flow between cathode and anode. The electrons of the current flow collide with the hydrogen or deuterium gas and enhance the conduction path by forming ions. In the hot gas, molecules of hydrogen (or deuterium) are excited and emit continuous ultraviolet radiation by decay to a lower state.

An unavoidable characteristic of thermionic electron emission is the sputtering away of the emitter material. As the emitter material decreases, the cathode voltage drop increases. Accordingly, a UV lamp design must balance the need to emit electrons with the need to conserve emitter material to ensure a long, useful life.

Currently, both 10 V and 3 V filaments are used in UV lamps. That is, a 10 V potential is impressed on the filament to generate the desired cathode temperature. It is also known to apply coatings of electron-emitter materials to filaments. One example is U.S. Pat. No. 2,306,925 (ELECTRODE AND ITS FABRICATION), the disclosure of which is hereby incorporated by reference. Emitter material is applied to a 3 V cathode by dipping the cathode into a triple carbonate solution (e.g., barium carbonate, calcium carbonate and strontium carbonate). The carbonate solution is allowed to dry onto the cathode. It is then oxidized to create a more stable alkaline crystal oxide (e.g., barium oxide, calcium oxide and strontium oxide). Dipping applies a layer of emitter material to the cathode of a 3 V UV lamp adequate to provide free electrons and acceptable product life before substantial evaporation.

However, dipping of known 10 V cathodes, in many cases, is not possible. The dimensions of cathode wire are driven by electrical requirements (e.g., attaining 10 V potential) and thermal requirements (i.e., the cathode must reach the thermionic temperature of the emitter material). The 10 V cathodes are normally made of wire approximately half the diameter of the 3 V cathode wire. The thinner wire used for a 10 V cathode is less rigid than that of a 3 V cathode, and has much smaller primary and secondary coils. These two factors make application of the emitter material by dipping impractical. Dipping a double-coil 10 V cathode will completely fill the interstices of the primary and secondary coils with emitter material. Thereafter, movement of the pliable double-coil 10 V cathode is likely to loosen and flake away the crystalline emitter material filling the interstices of the double-coil. Thus, the effective life of the double coil 10 V filament is substantially diminished. It is known to use a spraying technique to apply emitter material to 10 V cathodes. However, spraying is more expensive than dipping, and it applies less emitter material. Thus, the material evaporates more quickly, sometimes making the life of the UV lamp unacceptably short (i.e., less than 1000 hours).

Accordingly, it is desirable to provide a ultraviolet discharge lamp using the industry-standard 10 V cathode also having a useful life greater than 1000 hours.

BRIEF SUMMARY OF THE INVENTION

With parenthetical reference to the corresponding parts, portions or surfaces of the disclosed embodiment merely for purposes of illustration and not by way of limitation, the present invention provides a cathode filament for an ultraviolet discharge lamp (10). The lamp comprises a sealed bulb (11) occupied by a gas, such as hydrogen, deuterium, neon, argon, krypton or xenon. Inside the sealed bulb is an anode (35) and a heated cathode (30). The cathode is a coiled metal wire having an electron-emitting material. The coiled metal wire has a triple-coil configuration; that is, it comprises three coils: a primary coil (43), a secondary coil (41), and a tertiary coil (36). The primary and secondary coils of the triple coil are filled with emitter material (39). Filling the interstices of the primary and secondary coils provides greater volume of emitter material onto the cathode, thus increasing the life of the cathode and the lamp.

Accordingly, a general object of the invention is to provide a cathode element for an UV discharge lamp having a longer life.

Yet another object of the invention is to increase the amount of emitter material held by a cathode element.

Yet another object of the invention is to use a cathode having a greater stiffness, and less prone to vibrate.

Yet a further object of the invention is to provide a cathode for a 10 V-type UV discharge lamp that maintains the advantageous characteristics of 3 V-type UV lamps.

These and other objects and advantages will become apparent from the foregoing and ongoing written specification, the drawings and the appended claims.

DETAILED DESCRIPTION OF THE INVENTION

Figure 1:
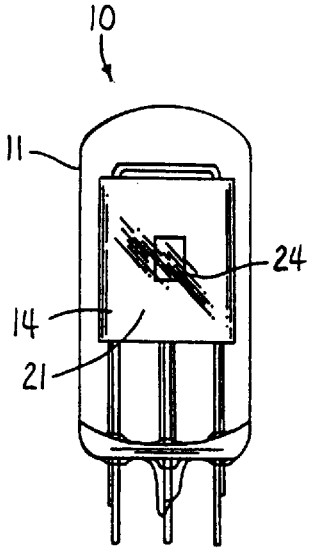
FIG. 1 is a front elevation of a 10 V UV lamp according to the invention.

At the outset, it should be clearly understood that like reference numerals are intended to identify the same structural elements, portions or surfaces consistently throughout the several drawing figures, as such element, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation as appropriate.

Adverting now to FIGS. 1–3B, a 10 V-type ultraviolet discharge lamp 10 according to the invention is shown to generally comprise a sealed quartz or ultraviolet glass bulb 11, an anode cylinder 12, a U-shaped cathode support 13 and a triangularly-shaped shield 14. Sealed bulb 11 is filled with a gas, normally hydrogen or deuterium. Anode cylinder 12 and shield 14 are made of nickel.

Anode cylinder 12 comprises a cylindrical member 15 having an outwardly-facing cylindrical surface 16, a recessed top surface 18, and a recessed bottom surface (not shown). Anode cylinder 12 is supported by leg 19 which is wrapped in ceramic 20.

Shield 14 includes a front member 21; side members, severally indicated at 22; and a plate member 23. Side members 22 are tangent, to and fixedly connected at that tangent point, to cylindrical surface 16. A rectangular aperture 24 is located in front member 21. A smaller rectangular aperture 25 is located in plate 23. Apertures 24 and 25 are equally distant from the base of shield 14. Shield 14 is supported by three legs, severally indicated at 26.

Figure 2:
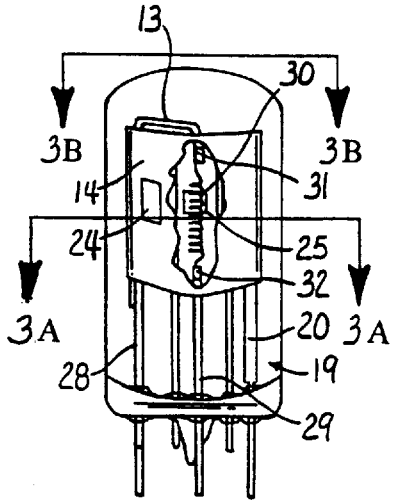
FIG. 2 is an end view of FIG. 1, partially in cut-away.

FIG. 2 shows UV lamp 10 with shield 14 partially cut away. U-shaped cathode support 13 comprises three portions, J-shaped support 28, rod support 29 and triple coil cathode ("TCC") 30, which is described in greater detail below. The top end and bottom end of TCC 30 have tin tabs 31 and 32, respectively. Tab 31 wraps around and fixedly attaches TCC 30 to J-shaped support 28. Similarly, tab 32 wraps around and fixedly attaches TCC 30 to rod support 29. Thus, a continuous electrical path is formed along cathode support 13.

A concave depression 33 is located in cylindrical surface 16 at the same level as apertures 24 and 25. A small aperture 34 is at the center of depression 33 and provides communication into otherwise-sealed anode cylinder 12.

Figure 3A:
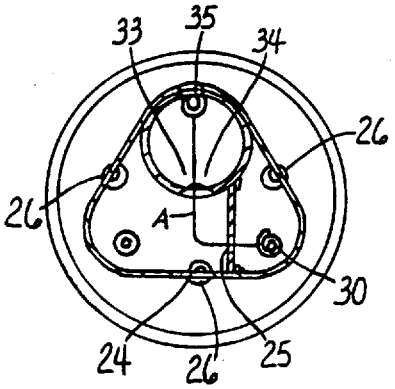
FIG. 3*a* is a cross-section taken along line 3*a*—3*a* of FIG. 2.
Figure 3B:
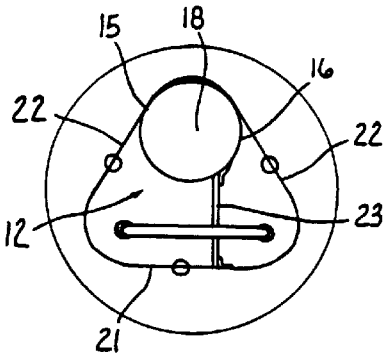
FIG. 3*b* is a cross-section taken along line 3*b*—3*b* of FIG. 2.

FIG. 3*a* provides a cross-section of UV lamp 10 along a line passing through apertures 24, 25 and 34. Anode 35 is the portion of leg 19 inside anode cylinder 12. The gas occupying bulb 11 exists in an "at-rest" state when no electric potential is applied to UV lamp 10. When an electric potential of 10 V is applied to cathode TCC 30, TCC 30 emits electrons, which are drawn sequentially through apertures 25 and 34 to anode 35 by an applied potential (approx. 70 V). Thus, current flow is established along path A. As the electrons travel between TCC 30 and anode 35, they collide with gas atoms and transfer enough energy to ionize the gas atoms and excite molecules. The excited molecules decay to a lower level by emitting energy in the form of ultraviolet light in an arc along path A.

Figure 4:
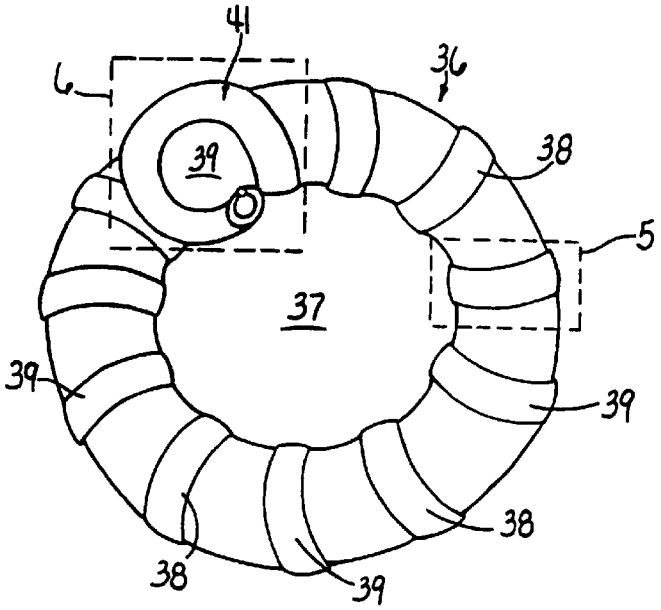
FIG. 4 is a end view of a tertiary coil of a triple-coil cathode.

Adverting now to FIG. 4 and end view of the tertiary coil 36 of TCC 30, its largest coil, is shown. Tertiary coil 36 defines a cylindrical space 37. Only the boundaries of tungsten wire 38 forming tertiary coil 36 are visible as the wire is coated with emitter material 39. The emitter material is traditionally an alkaline earth oxide in a crystalline structure. Examples are barium oxide (BaO), calcium oxide (CaO) and strontium oxide (SrO).

Figure 5:
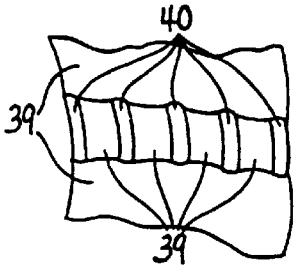
FIG. 5 is an enlargement of box 5 of FIG. 4.
Figure 6:
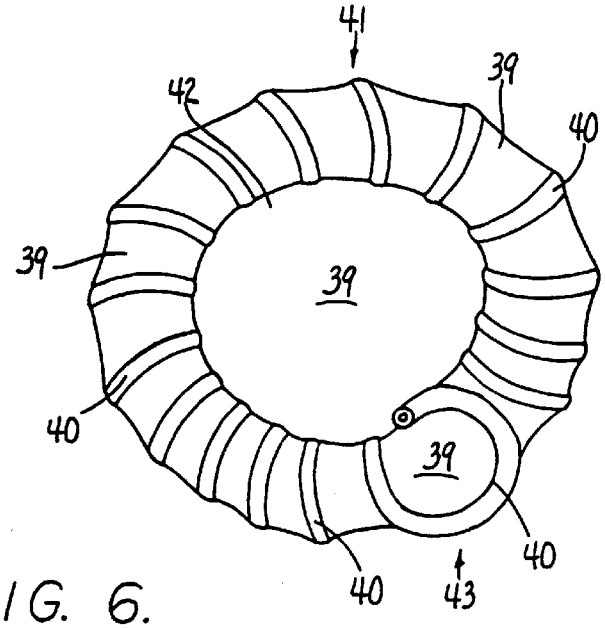
FIG. 6 is an enlargement of a secondary and a primary coil within box 6 of FIG. 4.

FIG. 5 is a close-up of one portion of tertiary coil 36 with the emitter material stripped away exposing the exterior surface 40 of tungsten wire 38. FIG. 6, which is an enlargement of another portion of FIG. 4, further shows that tertiary coil 36 itself is comprised of a smaller secondary coil 41. Secondary coil 41 defines a cylindrical space 42 occupied by emitter material 39. Emitter material 39 occupies the entire cylindrical length of secondary coil 41. In FIG. 6, the emitter material is partially stripped away to expose the exterior surface 40 of the tungsten wire 38 and clearly shows secondary coil 41 is comprised of a primary coil 43 of tungsten wire 38. Primary coil 43, like secondary coil 41, is occupied by emitter material 39. It has also been found that the triple-coil configuration is much stiffer than a double coil for a 10 V UV lamp. Thus, the triple coil is less likely to vibrate resulting in the breaking away of emitter material 39.

Figure 9:
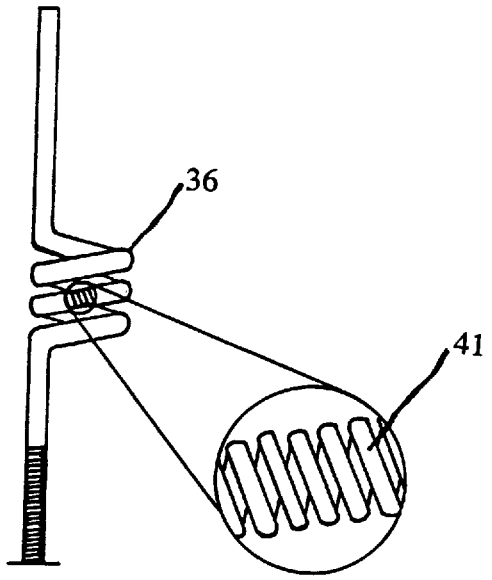
FIG. 9. (PRIOR ART)
FIG. 9 is a schematic view of a prior art double-coil filament showing the primary coil as being wound around the secondary coil, with an enlarged view of the primary coil being shown in the detail window.

FIG. 9 is a schematic view of a prior art double-coil filament showing the primary coil 41 as being wound around the secondary coil 36, with an enlarged view of the primary coil being shown in the detail window.

Figure 10:
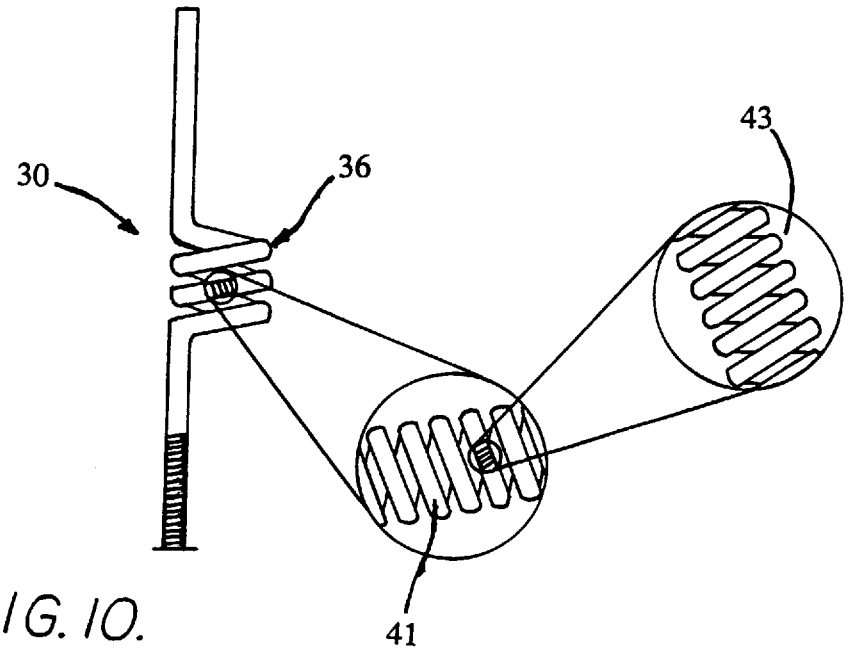
FIG. 10 is a schematic view of the improved triple-coil filament showing the primary coil as being wound around the secondary coil which, in turn is wound around the tertiary coil, with the primary coil being shown in the greatly-enlarged detail window to the far right, and with the secondary coil being shown in the intermediate enlarged detail window.

FIG. 10 is a schematic view of the improved triple-coil filament 30 showing the primary coil 43 as being wound around the secondary coil 41 which, in turn is wound around the tertiary coil 36, with the primary coil being shown in the greatly-enlarged detail window to the far right, and with the secondary coil being shown in the intermediate enlarged detail window.

Alkaline earth oxide emitter material 39 is thermionic. That is, when it reaches a certain temperature, it will begin to emit electrons. These electrons are needed to initiate the current transfer along path A. However, the thermionic process leads to evaporation of the metals of the emitter material.

In addition, the creation of gas ions promotes sputtering emitter material 39. The collision of electrons with gas atoms creates both negatively-charged ions and positively-charged ions. The positive gas ions accelerate and slam into negatively-charged TCC 30. In many instances, the positively charged ions strike and dislodge atoms in the emitter material 39.

Eventually, the thermionic process and sputtering deplete enough emitter material to substantially reduce the intensity of UV lamp 10. However, it has been found that loading primary coil 43 and secondary coil 41 of TCC 30 with emitter material significantly increases the effective life of TCC 30 by increasing the amount of emitter material on TCC 30 and by reducing the emitter losses from ion strikes. The triple coil shape holds a great volume of emitter material by not only coating the wire comprising TCC 30, but by filling the interstices of the coils. However, application of too much emitter material to TCC 30 can lead to a reduced lamp life. When emitter material occupies primary coil 43, secondary coil 41 and tertiary coil 36, the normally emitted electrons may be unable to transverse the increased material thickness effectively, thus reducing the intensity of UV lamp 10. In addition, the problems of brittleness and flaking found in dipped double-coil cathodes of the prior art reappear. Accordingly, the invention teaches the application of emitter material to fill the interstices of primary coil 43 and secondary coil 41.

Figure 7A:
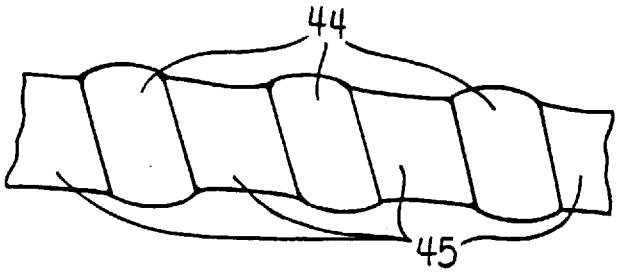
FIG. 7*a* is a front elevation of a portion of a primary coil.
Figure 7B:
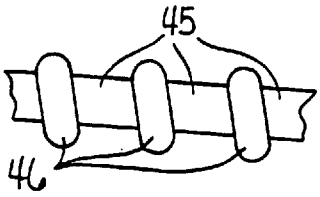
FIG. 7*b* is a front elevation of a portion of a primary coil.

Filling the interstices of primary coil 43 and secondary coil 41 also reduces the losses of emitter material from ion strikes. Adverting to FIG. 7*a*, a section of primary coil 43 is shown. The wire of primary coil 43 is coated with emitter material 44, and the coil itself is also occupied by emitter material 45. This is what a new TCC 30 would look like. Adverting to FIG. 7*b*, The evaporation of the outer layer of the emitter material, leaves tungsten coil portions 46 protruding beyond the remaining emitter material 45. Tungsten coil portions 46 are now more likely to attract the positive gas ions into a collision, thus reducing the number of ion impacts with the remaining emitter material 45. Tungsten wire portions 46 are less likely to evaporate from positive ion bombardment than emitter material 45. It is also possible to intentionally strip away emitter material outer layer 44 prior to shipping to reduce variation in the UV lamp intensity over its life.

Figure 8:
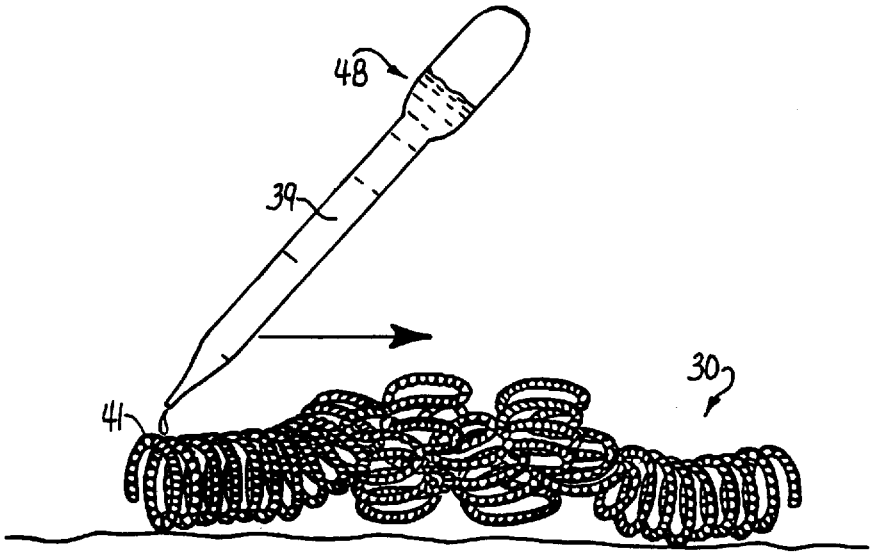
FIG. 8 shows the process of "dabbing" emitter material onto a triple coil cathode.

As previously discussed, dipping TCC 30 would likely apply too much emitter material (e.g., it would occupy the interstices of tertiary coil 36), while spraying does not fill the interstices of primary coil 43 and secondary coil 41. It has been found that a process described as "dabbing" fills the interstices of primary coil 43 and secondary coil 41 without filling the interstices of tertiary coil 36. FIG. 8 shows dabbing. A pipette 48 having emitter material in a solution 39 (e.g., barium carbonate, calcium carbonate or strontium carbonate) and having a tip 49 similar in size to secondary coil 39 is drawn along secondary coil 41.

Gravity draws the emitter material solution into primary coil 43 and secondary coil 41. Surface tension holds the emitter material solution until it dries. An oxidation process is eventually performed on TCC 30, to transform the dry solution into a crystalline oxide structure such as barium oxide, calcium oxide or strontium oxide occupying the interstices of primary coil 43 and secondary coil 41.

Test data was collected to gauge the improvement in UV lamp intensity maintenance in a lamp having a TCC according to the invention. Current cathodes from two commercially-available 10 V UV lamps, designated by numbers 18026 and 24160, manufactured by Imagining & Sensing Technology Corporation of Horseheads, New York, were replaced by a TCC according to the invention. The modified TCC UV lamps were then compared against a group of unmodified 18026 and 24160 UV lamps. The intensity of each lamp was measured at 500 hours and 800 hours as a percent of intensity observed at 0 hours. The results are presented below.

| | Cathode | Intensity Maintenance | | | |
|---|---|---|---|---|---|
| Lamp Type | Type | 500 hr. | Improvement | 800 hr. | Improvement |
| 18026 | TCC | 86% | +22.22% | 78% | +15.38% |
| | Standard | 82% | | 74% | |
| 24160 | TCC | 90% | +28.57% | 86% | +22.22% |
| | Standard | 86% | | 82% | |

Modifications

The present invention contemplates various changes and modifications may be made without departing from the invention. For example, a TCC manufactured according to the invention can be used in other than hydrogen and deuterium lamps. Examples of other lamps are neon lamps, argon lamps, krypton lamps and xenon lamps. This, of course, is not a full list of other possible lamps as the chosen gas, or combination of gases, in the sealed bulb is driven by the light wavelength required.

Also, the dimensions of the TCC may be altered while still remaining within the spirit of the invention. The preferred TCC is shown in the disclosure to include two tertiary coil turns. However, there is nothing to limit the invention to two tertiary coil turns or to the proportional dimensions shown. Therefore, while the presently-preferred embodiment of the TCC has been shown and described, and several modifications thereof discussed, persons skilled in the art will appreciate that various additional changes and modifications may be made without departing from the spirit of the invention as defined and differentiated by the following claims.

We claim:

1. In an ultraviolet discharge lamp comprising a sealed bulb occupied by a gas, said bulb also holding an anode and a heated cathode, said cathode comprising a single coiled metal wire coated with an electron emitting material, the improvement comprising:

said coiled metal wire having three coils, a primary coil, a secondary coil, and a tertiary coil; and said material occupies the interstices of said primary and secondary coils but not said tertiary coil.

2. The ultraviolet lamp as described in claim 1 wherein said gas is hydrogen, deuterium, hydrogen and deuterium, or deuterium and an inert gas.

3. The ultraviolet lamp as described in claim 1 wherein said heated cathode is directly heated.

4. The ultraviolet lamp as described in claim 1 wherein said wire is tungsten.

5. The ultraviolet lamp as described in claim 1 wherein said material is an alkaline earth oxide.

6. The ultraviolet lamp as described in claim 5 wherein said alkaline earth oxide is barium oxide.

* * * * *